United States Patent [19]

Kontes

[11] 4,074,824

[45] Feb. 21, 1978

[54] CONTAINER FOR STORAGE AND SHIPMENT OF CHEMICAL STANDARDS, RADIOACTIVE ISOTOPES AND THE LIKE

[75] Inventor: James Constantine Kontes, Vineland, N.J.

[73] Assignee: Kontes Glass Company, Vineland, N.J.

[21] Appl. No.: 637,397

[22] Filed: Dec. 3, 1975

[51] Int. Cl.[2] ..... B65D 15/24

[52] U.S. Cl. ..... 215/365; 215/12 R

[58] Field of Search ..... 215/12 R, 365; 23/292

[56] References Cited

U.S. PATENT DOCUMENTS

| | | | |
|---|---|---|---|
| 868,963 | 10/1907 | Bruebach | 215/12 R |
| 1,459,023 | 6/1923 | Guest | 215/12 R |
| 1,650,801 | 11/1927 | Marcus | 215/12 R UX |
| 2,279,075 | 4/1942 | Street | 215/12 R |
| 2,533,349 | 12/1950 | Burger | 215/12 R |
| 2,866,569 | 12/1958 | Morrison | 215/12 R |
| 3,481,712 | 12/1969 | Bernstein | 23/292 |
| 3,773,468 | 11/1973 | Hubbard | 23/292 X |
| 3,811,591 | 5/1974 | Novitch | 215/12 R |

*Primary Examiner*—Donald F. Norton

*Attorney, Agent, or Firm*—Sixbey, Bradford & Leedom

[57] ABSTRACT

A container particularly suitable for use in the scientific market for storage and shipment of chemical standards, radioactive isotopes, and the like. The overall container includes an inner glass vial having a bottom end of inner pointed configuration to permit a researcher or the like to retrieve all of the sample, or material, contained therein via a syringe needle. The inner glass vial is inserted into an outer holder fabricated from a material which serves to protect the inner vial and means are provided in the outer holder or cover for viewing the contents in the inner vial.

The function of the holder is to reduce weight, provide means of standing the vial upright, allow visibility to contents and provide a safety shield to guard against accidental breakage. Means are also included for closing and sealing the interior vial.

9 Claims, 6 Drawing Figures

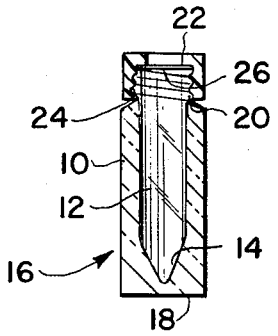
FIG. 1 PRIOR ART
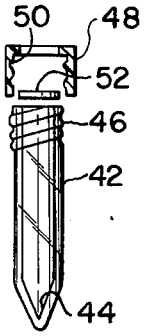
FIG. 2
FIG. 3
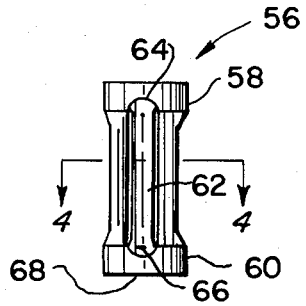
FIG. 4
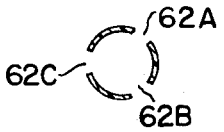
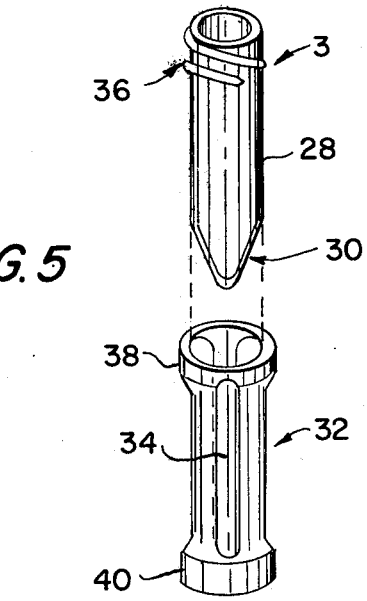
FIG. 5
FIG. 6
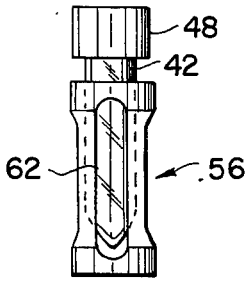

CONTAINER FOR STORAGE AND SHIPMENT OF CHEMICAL STANDARDS, RADIOACTIVE ISOTOPES AND THE LIKE

A wide variety of closure finishes can be utilized to accommodate numerous different cap configurations. The two component parts, the glass insert and the outer holder, may be secured if desired by an adhesive, a pressed fit of a lock type joint at the discretion of the manufacturer.

Heretofore storage and shipment containers for use in connection with isotopes which are radioactive and the like have consisted of heavy glass containers in which the interior is hollowed out in order to contain the material and in certain embodiments does include a pointed lower end of the inner recess in order to permit the user to remove the last portions of the material therein since even a single drop, for example, of radioactive material could easily be worth well over a hundred dollars. Such prior constructions utilized a heavy glass construction in order to provide the safety aspect and the small interiors were machine made with the product per se being die molded for example.

The interior configuration per se in other words is not new and many such containers were sold and used. These prior containers could if desired include areas treated for appropriate marking on the exterior, ground or otherwise treated bottoms to insure that the container would stand upright. The thick wall was for the purpose of safety and the exterior could also include a numerical marking or the like to indicate content remainder in the vial.

Such prior constructions as shown in the drawings for example in FIG. 1 have been found to be costly and slow in manufacture, as well as bulky and heavy.

The present invention is designed principally to overcome these drawbacks of the prior known containers and can be produced utilizing thin walled glass tubes or the like, drawn or otherwise treated to produce an inner lower or bottom pointed end, and this glass vial can be inserted in a protective holder in a friction fit or the like, and have a see-through arrangement of this protective outer holder.

If desired the glass can be colored or otherwise the plastic can be colored. Such coloring can be indicative of the contents such as "red" for radioactive material. In any event the outer cover must be of such a configuration and arrangement as to expose the bottom of the pointed vial in order to insure that the material contained therein is known and removable by the user.

Additional objects and advantages of the invention will be more readily apparent from the following detailed description of an embodiment thereof when taken together with the accompanying drawings in which:

FIG. 1 is a sectional pictorial representation of prior used constructions including a heavy glass body in which an inner vial is machined;

FIG. 2 is an exploded sectional pictorial view of the inner vial, sealing disk and cap of the present invention;

FIG. 3 is an elevational view of the external holder adapted for containment of the inner vial of FIG. 2;

FIG. 4 is a sectional view taken on line 4—4 of FIG. 3;

FIG. 5 is a composite external view of an exploded nature showing the manner of use and assembly of the invention; and FIG. 6 is an assembled view of the detailed part showing of FIGS. 2, 3 and 4.

Referring now in detail to the drawings, the known and heretofore used construction shown in FIG. 1 includes a body portion 10 of heavy glass which peferably was heretofore die molded and the known prior constructions were machine made products. The heavy body portion 10 of glass had machined or otherwise made therein a hollow interior 12 in the nature of an inner vial for holding of the material and as shown the lower or bottom end of the hollow interior vial terminates in a sharp point at 14 for reasons hereinbefore described. The glass jar generally designated 16 was preferably dressed such as by grinding in order to provide a flattened surface at 18 and also slightly roughened to prevent sliding and insure correct positionment on a support.

The upper end of body portion 10 was provided with threads generally indicated at 20 for coaction with a closing and sealing cap 22 having internal threads 24 for operative engagement with threads 20. A sealing disk 26 preferably of a resilient and imprevious material is inserted within the cap and positioned over the upper opening of the inner vial as shown.

As hereinbefore mentioned such a prior construction is of costly manufacture since machine made and die molded, with a machining or other formation of the small interior opening or container in the nature of vial. The present invention is primarily designed to overcome these drawbacks and this new construction will be explicitly described with reference to FIGS. 2–6 inclusive hereinbelow.

Generally speaking, referring to FIG. 5, the unit is comprised of a glass insert 28 having a very significant pointed bottom 30 which slides or fits into a molded or machined holder 32 which hereinafter will be referred to as a protective holder while having other functions as will appear. This holder 32 is preferably machined and fabricated from rigid or semi-rigid material. The function of the holder is to reduce the weight that the entire composite unit of the invention would have as compared to a construction if made in one piece of glass for example as shown in the heretofore used embodiment of FIG. 1. The holder additionally provides a means of standing the vial composite construction upright and allows visibility by virtue of the elongated openings 34 in the sides thereof. It is to be noted that these openings must be of sufficient number to permit light to be passing through the vial and the contents to be seen through another of the openings. The number and arrangement of the viewing openings obviously can differ. The holder 32 provides a safety shield to guard the relatively thin interior glass vial 28 which can be formeed of glass tubing or the like with the absence of costly and time-consuming machining prevalent in the prior constructions.

This holder 32 can be color coded or custom colored to reflect capacity through an entire capacity range of the product or to indicate generally the nature of the contents as set forth hereinabove.

A wide variety of closure finishes such as generally indicated by threads at 36 can be used to accommodate all cap configurations. Also as heretofore pointed out the two component parts may additionally be secured by an adhesive, a pressed fit, or a lock type joint at the discretion of the manufacturer.

It will also be noted as shown, in FIG. 5, a top enlargement 38 in the nature of a boss is included, and a bottom enlargement provided as at 40. The purposes of these enlarged areas or portions are for stability and strength although it is not necessary that they be formed as such as will appear hereinafter. It is also to be noted in this configuration or embodiment that the elongated slots or openings 34 terminate short of the top and bottom enlargement. It is also to be significantly noted that the pointed bottom 30 will terminate short of the bottom of the holder in assembled relationship.

Another and preferred embodiment is shown in the FIGS. 2–4 inclusive. The glass insert shown in FIG. 2 consists of a relatively thin walled glass vial 42 which can be formed from, for example, a glass tube and which under some circumstances can be colored or otherwise treated to be indicative of the contents thereof. A pointed lower end 44 is again provided as also a threaded upper end 46 for coaction with a closure cap 48 preferably of a molded plastic construction having internal threads as at 50. A resilient sealing disk 52 is adapted to cover the mouth 54 of vial 42 and be held in place by means of the cap 48. This vial 42 is inserted in the interior of plastic outer sheath or shield 56 which again is preferably molded or machined and fabricated from a rigid or semi-rigid material. This outer sheath includes an upper thickened end portion 58 in the nature of a surrounding or structural strengthening ring. The bottom also includes such a strengthening ring or enlargement as at 60. Slots or openings are provided at 62 to permit viewing of the contents of inner vial 42. It is to be noted that in this embodiment the upper end 64 and lower end 66 extend into the thickened ring portions 58 and 60. Such arrangement can obviously be modified so long as the interior of the construction, namely the vial, is readily apparent to disclose the volume or content therein. Again and as shown by the positionment of FIGS. 2 and 3 the pointed lower end 44 of the vial terminates short of the bottom 68 of the outer sheath or protective covering with this lower end or bottom 68 serving as a base for standing the vial upright and otherwise providing a protection to the lower end. The disposition of the slots 62 can be seen from FIG. 4 which discloses a single embodiment in which three slots designated as 62A, 62B and 62C are shown. The number and arrangement of the slots is as pointed out above critical to insure that the contents of the inner vial are apparent from the exterior.

While the embodiments shown are representative of certain aspects and concepts of the invention, the overall assembly being shown in elevation in FIG. 6, manifestly minor changes in details of construction can be effected without departing from the spirit and scope of the invention as defined in and limited solely by the appended claims.

I claim:

1. A composite container particularly suited for storage and shipment of chemical standards, radio-active materials in the nature of isotopes, and the like, comprising an inner thin walled hollow transparent glass vial having a smooth surfaced interior terminating in a significantly pointed interior bottom, said vial having a likewise pointed exterior bottom, the wall of said vial having a substantially uniform wall thickness throughout its length, an outer cover constituting a protective safety shield and vial holder, said vial being inserted in said outer cover and retained therein, said outer cover surrounding said inner vial and extending below the pointed bottom exterior of said vial, with said bottom exterior being thereby spaced upward from the bottom of said outer cover thereby providing protection for said pointed end and a means of standing said vial upright and providing support to the overall composite container in this position said outer cover having a plurality of longitudinally extended openings through the side wall thereof terminating short of the upper and lower ends thereof to permit visibility of contents in said inner vial, the lower end of at least one said opening extending below the pointed bottom exterior of said inner vial.

2. A composite container as claimed in claim 1, wherein said openings are of elongated configuration and including several such openings spaced around the periphery thereof to insure light transmission through said glass vial to facilitate viewing of contents in said vial.

3. A composite container as claimed in claim 1, wherein said outer cover is color coded by having a color in accordance with an established code to indicate holding capacity of containers.

4. A composite container as claimed in claim 1, wherein said outer cover is custom colored in accordance with an established code to indicate contents of the material within said inner vial.

5. A composite container as claimed in claim 1, wherein the inner glass vial and external cover respectively have an inner rectilinear shape and size and an external rectilinear shape and size for close continuous fitment over substantially the respective mating lengths thereof.

6. A composite container as claimed in claim 5, wherein said outer cover is fabricated from a resilient material selected from a group including teflon, polypropylene and the like materials.

7. A composite container as claimed in claim 1, wherein said glass vial contains coloring in the glass material in accordance with an established code to denote nature of the contents thereof.

8. A composite container as claimed in claim 1, wherein said outer cover consists of a substantially regular cylindrical shaped central portion, and includes a peripheral end flange of greater thickness at the bottom for secure upright container positioning and providing means for standing the vial upright and exterior pointed end protection.

9. A composite container as claimed in claim 8, wherein the opposite end of said external cover has a similar enlarged configuration for added strength and safety, the enlarged ends serving to space the intermediate cover from contact with adjacent surfaces and objects.

* * * * *